US006832792B2

(12) United States Patent
Polowinczak et al.

(10) Patent No.: US 6,832,792 B2
(45) Date of Patent: Dec. 21, 2004

(54) ACTUATOR FOR A TILT-LATCH FOR A SASH WINDOW

(75) Inventors: Allen D. Polowinczak, Plainfield, IL (US); Vincent F. Eslick, Chicago, IL (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 10/219,059

(22) Filed: Aug. 14, 2002

(65) Prior Publication Data

US 2003/0047948 A1 Mar. 13, 2003

Related U.S. Application Data

(63) Continuation-in-part of application No. 09/713,163, filed on Nov. 14, 2000.

(51) Int. Cl.[7] ..... E05C 1/06; E05C 1/12; E05C 7/00; E05C 9/16

(52) U.S. Cl. ..... 292/36; 292/DIG. 47; 292/DIG. 33; 292/163; 292/145

(58) Field of Search ..... 292/175, 163, 292/DIG. 47, 145, DIG. 33, 146, 147, 178, 150, 152, 36

(56) References Cited

U.S. PATENT DOCUMENTS

| | | | | | |
|---|---|---|---|---|---|
| 16,228 | A | | 12/1856 | Copeland | |
| 266,601 | A | * | 10/1882 | Blayney | 292/57 |
| 338,463 | A | * | 3/1886 | Barrett | 40/460 |
| 543,226 | A | * | 7/1895 | Atwood | 292/175 |
| 1,378,622 | A | * | 5/1921 | Sarbij | 292/142 |
| 1,781,729 | A | | 11/1930 | Major | |
| 2,568,273 | A | | 9/1951 | Clark | |
| 2,965,935 | A | | 12/1960 | Olsen | |
| 3,080,621 | A | | 3/1963 | Mendelsohn | |
| 3,122,797 | A | | 3/1964 | Segre | |
| 3,841,674 | A | | 10/1974 | Bisbing et al. | |
| 3,850,464 | A | | 11/1974 | Bisbing et al. | |
| 4,167,835 | A | | 9/1979 | Nobes et al. | |
| 4,400,026 | A | | 8/1983 | Brown, Jr. | |
| 4,475,311 | A | | 10/1984 | Gibson | |
| 4,482,178 | A | | 11/1984 | Damiana | |
| 4,553,353 | A | | 11/1985 | Simpson | |
| 4,578,903 | A | | 4/1986 | Simpson | |
| 4,581,850 | A | | 4/1986 | Simpson | |
| 4,622,778 | A | | 11/1986 | Simpson | |
| 4,657,206 | A | * | 4/1987 | Matsumoto et al. | 292/173 |
| 4,669,765 | A | | 6/1987 | Ullman | |
| 4,790,579 | A | | 12/1988 | Maxwell et al. | |
| 4,791,756 | A | | 12/1988 | Simpson | |
| 4,824,154 | A | | 4/1989 | Simpson | |
| 4,837,975 | A | | 6/1989 | Simpson | |
| 4,895,400 | A | * | 1/1990 | Harding et al. | 292/145 |
| 4,901,475 | A | | 2/1990 | Simpson | |
| 4,917,413 | A | | 4/1990 | Jason et al. | |
| 5,028,083 | A | | 7/1991 | Mischenko | |

(List continued on next page.)

*Primary Examiner*—John B. Walsh
(74) *Attorney, Agent, or Firm*—Wallenstein Wagner & Rockey, Ltd.

(57) ABSTRACT

A tilt-latch (10) adapted for releasably securing a sash window (12) to a master frame (14) of a window sash assembly (11) is disclosed. The tilt-latch (10) comprises a housing (42) having an outward end opening (44) and an inner wall (55). A latch bolt (46) is disposed within the housing (42) and has a nose (47) adapted for engaging a respective one of a pair of guide rails (16) of the window assembly (11). The latch bolt (46) also has at least one protrusion (124). The latch bolt (46) is moveable between a deployed position wherein the nose (47) extends through the outward end opening (44) and the protrusion (124) is spaced from the inner wall (55), and a retracted position wherein the protrusion (124) engages a trailing edge (55*c*) of the inner wall (55) to maintain the latch bolt (46) in the retracted position.

52 Claims, 9 Drawing Sheets

U.S. PATENT DOCUMENTS 5,068,932 A 12/1991 Chang
5,096,240 A 3/1992 Schulz
5,121,951 A 6/1992 Harbom et al.
5,121,952 A 6/1992 Jason
5,127,685 A 7/1992 Dallaire et al.
5,139,291 A 8/1992 Schultz
5,145,221 A 9/1992 Pennebaker et al.
5,165,737 A 11/1992 Riegelman
5,465,191 A 11/1995 Nomura et al.
5,618,067 A 4/1997 Carlson et al.
5,669,180 A 9/1997 Maier
5,669,639 A 9/1997 Lawrence
5,671,958 A 9/1997 Szapucki et al.
5,806,900 A 9/1998 Bratcher et al.
5,829,196 A 11/1998 Maier
5,927,013 A 7/1999 Slocomb et al.
5,970,656 A 10/1999 Maier
5,996,283 A 12/1999 Maier
6,021,603 A 2/2000 Prete et al.
6,135,512 A * 10/2000 Galvin ..... 292/163
6,155,615 A 12/2000 Schultz
6,178,696 B1 1/2001 Liang
6,183,024 B1 2/2001 Schultz et al.
6,230,443 B1 5/2001 Schultz
6,299,223 B1 * 10/2001 Ji et al. ..... 292/175
6,340,183 B1 1/2002 Ramsauer
6,508,495 B1 * 1/2003 Riley ..... 292/152

* cited by examiner

ACTUATOR FOR A TILT-LATCH FOR A SASH WINDOW

RELATED APPLICATION

This Application is a Continuation-in-Part Application (CIP) of application Ser. No. 09/713,163 filed Nov. 14, 2000, which is expressly incorporated herein.

TECHNICAL FIELD

The present invention relates to a tilt-latch for a pivotal sash window assembly and, more particularly to a tilt-latch actuator adapted to be connected to a latch bolt of the tilt-latch.

BACKGROUND OF THE INVENTION

A pivotal sash window adapted for installation in a master frame of a sash window assembly is well-known. The sash window assembly typically has opposed, vertically extending guide rails to enable vertical reciprocal sliding movement of the sash window in the master frame while cooperatively engaged with the guide rails. The sash window has a top sash rail, a base and a pair of stiles cooperatively connected together at adjacent extremities thereof to form a sash frame, usually a rectangular frame. Typically, a pair of spaced tilt-latches are installed on, or in, opposite ends of the top sash rail.

Each tilt-latch is generally comprised of a housing having an outward end opening and a latch bolt disposed within the housing. A spring disposed within the housing generally biases the latch bolt through the outward end opening to engage the guide rails of the master frame. The latch bolt has an actuator structure to allow for actuation of the latch bolt. The actuator structure is typically a small control button that is connected to the latch bolt. An operator can use his finger to engage the actuator wherein the latch bolt is retracted into the housing. This releases the latch bolt from the guide rail. When the latch bolts of the opposed tilt-latches are actuated simultaneously, the sash window can then be pivoted from the master frame.

A tilt-latch mounted in a top sash rail is typically called a flush-mount tilt-latch. Examples of this type of tilt-latch are shown in U.S. Pat. No. 5,139,291, and U.S. Pat. No. 6,155,615, both assigned to Ashland Products, Inc., the assignee of the present invention, and incorporated by reference and made a part hereof. To accommodate the flush-mount tilt-latch in the top rail, a slot is punched or routed in the top rail.

Pivotal sash window assemblies can be constructed from different materials such as vinyl or wood materials. Tilt-latches and other window hardware components have often been made from plastic using injection molding technology. Such components have also been made from metal materials such as zinc. In a wood window application or simulated wood window application wherein the window assembly has a simulated wood appearance (e.g., wood-style laminate applied over a PVC extrusion), consumers have oftentimes preferred the aesthetic features of metal hardware over plastic hardware. A plastic tilt-latch is just not as aesthetically pleasing in a wood window as a metal tilt-latch. Thus, in wood windows, tilt-latches made from zinc are often used. Zinc tilt-latches, like other metal hardware, are typically more robust that traditional plastic tilt-latches, but also more expensive. In addition, due to the sliding interaction between the metal components of zinc tilt-latches upon actuation, unwanted noise is produced. As a result, consumers sometimes conclude that the zinc tilt-latches, when actuated, do not possess smooth operational characteristics. Expressed differently, the zinc tilt-latches, when actuated, may produce an unwanted metal-on-metal "ringing" sound. Consumers then may question the quality of the tilt-latches due to the unwanted noise produced during actuation. In addition, all zinc tilt-latches include a zinc latch bolt having a nose that is adapted to engage a respective one of the guide rails of the master frame. Because of the hardness of zinc, the latch bolt nose can sometimes damage wood or plastic guide rails when the sash window is pivoted to a closed position where the nose engages an outer portion of the guide rail and moves into the brake shoe channel.

The present invention is provided to solve these and other problems.

SUMMARY OF THE INVENTION

It is an object of the present invention to provide a tilt-latch adapted for releasably securing a pivotable sash window to a master frame of a sash window assembly.

The master frame has opposed, vertically extending guide rails. The sash window has a top sash rail, a base and a pair of stiles cooperatively connected together at adjacent extremities to form a frame. The top sash rail includes a pair of opposing header slots. Each of the header slots forms a pair of opposing, longitudinal header rails.

In accordance with one aspect of the invention, the tilt-latch has a housing adapted to be supported by the top rail. The housing has an outward end opening and a cover. A latch bolt is disposed within the housing and has a nose adapted for engaging a respective one of the guide rails. An actuator is connected to the latch bolt and sized to be positioned over the entire cover.

According to another aspect of the invention, the cover has opposed longitudinal peripheral edges and the actuator has opposed depending longitudinal flanges. The flanges are positioned over the peripheral edges. The flanges slide along the peripheral edges when the latch bolt is retracted into the housing.

According to a further aspect of the invention, the housing is adapted for substantially flush installation in the top rail wherein the cover is positioned on the top rail. The actuator slides along the cover when retracting the latch bolt into the housing exposing a front segment of the cover.

According to yet another aspect of the invention, the latch bolt has a slot and the actuator has a post. The post is received by the slot when the actuator is connected to the latch bolt. In addition, the latch bolt has a finger extending into the slot and the actuator post has a tab. The tab engages an underside of the finger. The actuator further has a pair of ridges depending from an underside of the actuator and extending from the post.

According to a further aspect of the invention, the cover has an underside surface having a recessed portion. The recessed portion accommodates the cover of the housing. In a preferred embodiment of the invention, the cover is rectangular and the recessed portion is also rectangular and corresponds in size to the cover. The cover has a rear transverse edge that engages a rear transverse edge defined by the recessed portion.

According to another aspect of the invention, the actuator has a control button.

According to a further aspect of the invention, the housing is adapted for substantially flush installation in the top rail. The actuator slides along a top surface of the top rail when the latch bolt is retracted into the housing.

According to another aspect of the invention, the actuator is made from metal. In a most preferred embodiment of the invention, the actuator is made from zinc. The housing and latch bolt are preferably made from plastic.

According to another aspect of the invention, the housing and latch bolt have a cooperating mechanism to maintain the latch bolt in a retracted position. In one embodiment, the housing has one of an inner wall and a protrusion. The latch bolt has the other of the inner wall and the protrusion. The latch bolt has an extended position wherein the nose of the latch bolt extends through the outward end opening and wherein the protrusion is spaced from the wall. The latch bolt further has a retracted position wherein the protrusion engages the wall to maintain the latch bolt in the retracted position.

According to another aspect of the invention, the tilt-latch has means for visually indicating that the latch bolt is in the retracted position. In one preferred embodiment, the means for visually indicating is a color indication. In one form, the housing has a first color and the actuator has a second color visually distinct or perceptively different from the first color. The first color is visible when the latch bolt is in the retracted position.

Other features and advantages of the invention will be apparent from the following specification taken in conjunction with the following drawings.

DETAILED DESCRIPTION OF THE INVENTION

Figure 1:
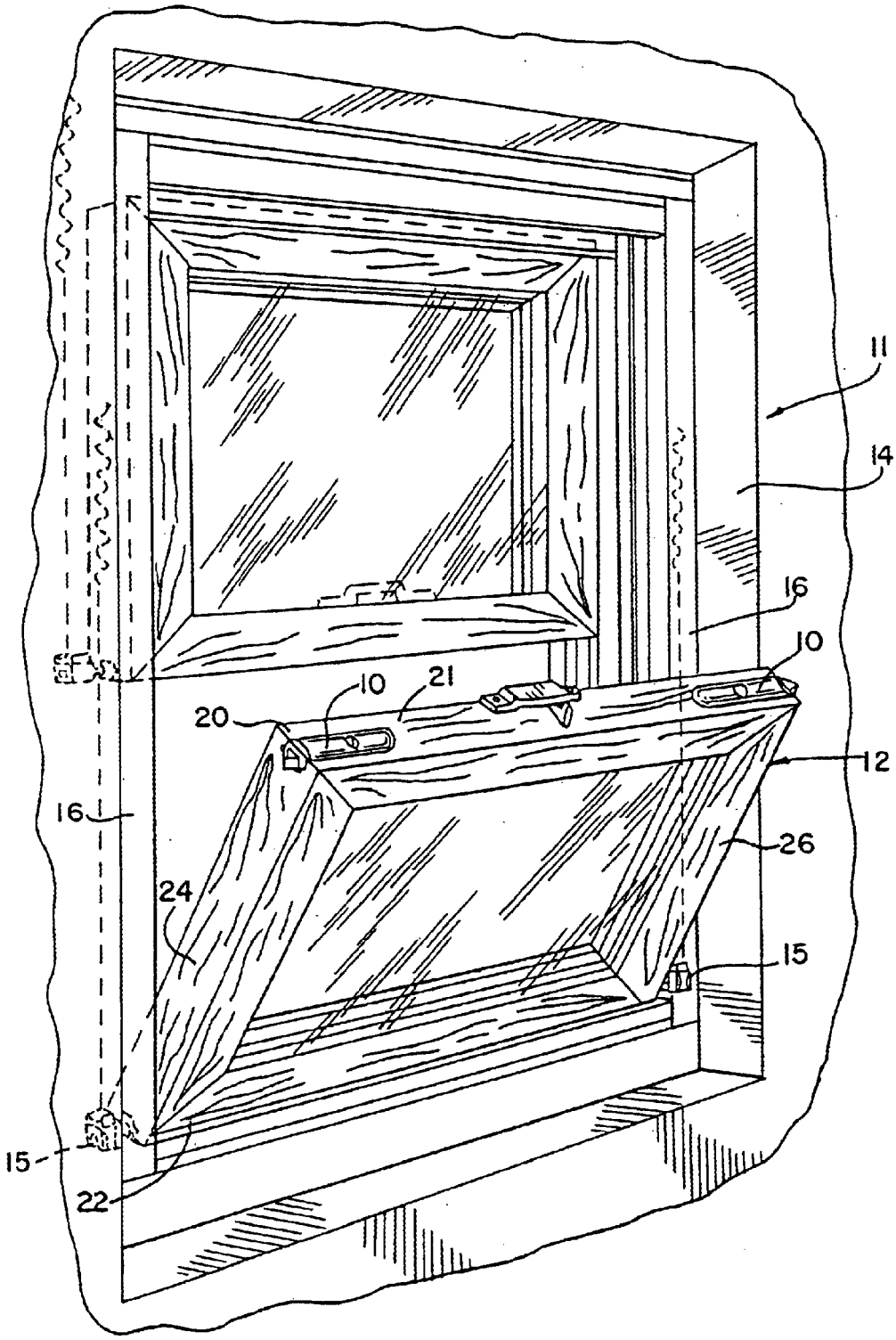
FIG. 1 is a perspective view of a double-hung sash window assembly utilizing tilt-latches each having a tilt-latch actuator according to the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 shows a tilt-latch of the present invention, generally designated with the reference numeral 10, used in a sash window assembly 11. The sash window assembly 11 shown in FIG. 1 is a double-hung window assembly having a pivotal sash window 12 installed in a master frame 14. The particular sash window assembly 11 shown in FIG. 1 is also made from wood although it could also be made from other materials. The tilt-latch 10 could also be used in all types of pivotal windows or structures. The sash window 12 is pivotally mounted to the master frame 14 by a sash balance/brake shoe assembly 15. As is well known, the master frame 14 has opposed, vertically extending guide rails 16. The sash window 12 has a top sash rail 20 having a top surface 21, a base 22 and a pair of stiles 24,26, cooperatively connected together at adjacent extremities thereof to form a sash frame, typically rectangular although other shapes are possible.

Figure 7:
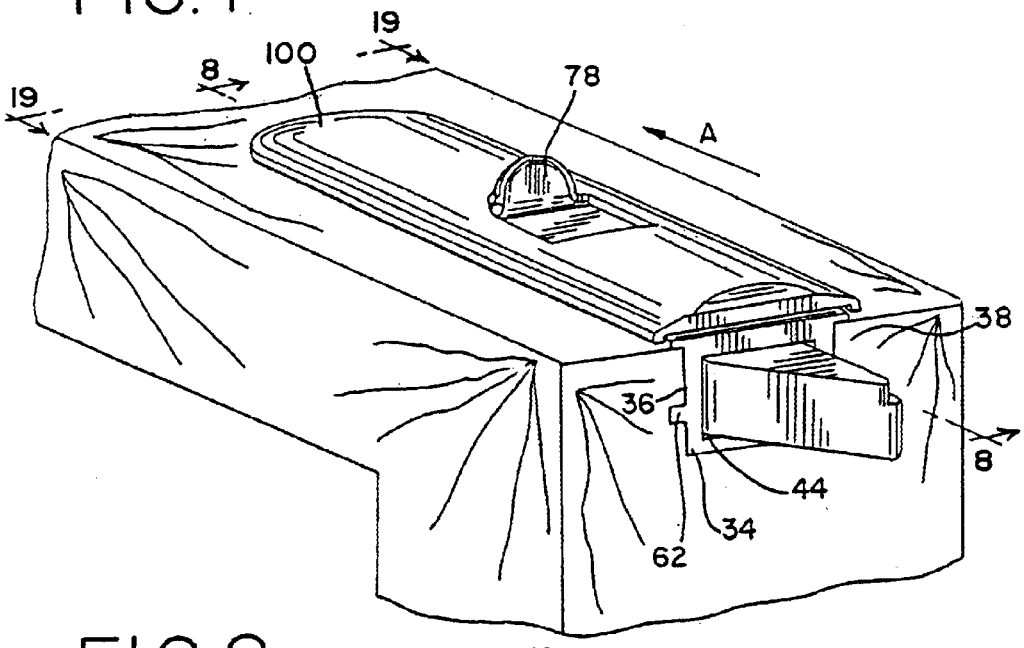
FIG. 7 is a partial perspective view of the tilt-latch installed in a top rail of a sash window.

As discussed, in a most preferred embodiment of the invention, the sash frame is made from solid wood. The sash frame could also be made from simulated wood materials. Other solid structures are also possible such as masonite or pressboard. The sash frame could also be made from extrusions or pulltrusions that are filled with fiberglass, epoxy, plastic, or wood chips. If desired, the sash frame could also be hollow such as when made from PVC extrusions. As shown in FIGS. 1 and 7, the top sash rail 20 includes a pair of opposing header slots 34, which are formed such as by routing the top sash rail 20. The top sash rail 20 could also be punch-routed. In applications where the top sash rail 20 is a hollow extrusion, the header slots 34 may be formed by prepunching the top sash rail 20. Each of the header slots 34 forms a pair of opposing, longitudinal header rails 36, 38.

Figure 2:
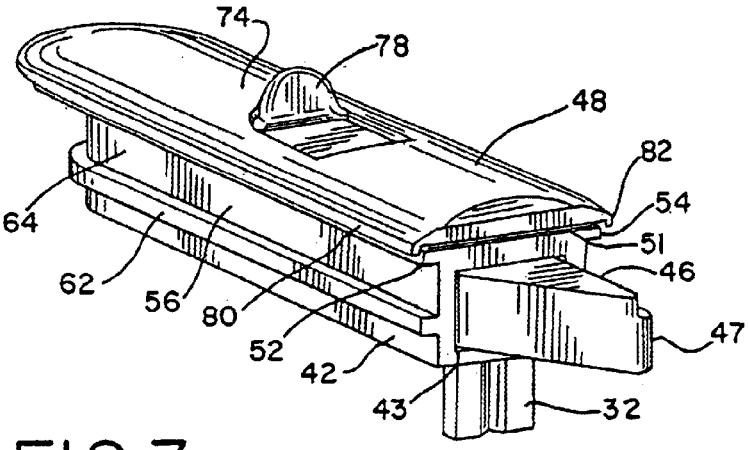
FIG. 2 is a perspective view of the tilt-latch of FIG. 1.
Figure 3:
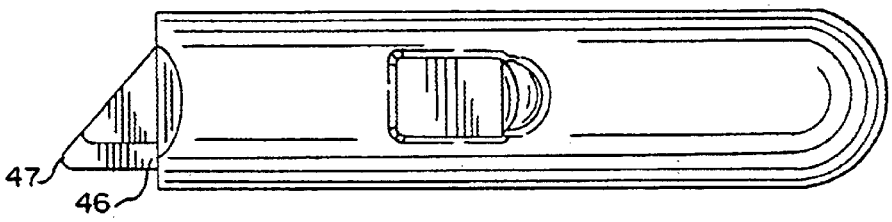
FIG. 3 is a plan view of the tilt-latch.

As shown in FIGS. 2–10, the tilt-latch 10 generally comprises a housing 42, a latch bolt 46, an actuator 48 and a spring 50. With the exception of the actuator 48, the tilt-latch components are similar to the components shown in U.S. Pat. No. 5,139,291, assigned to Ashland Products, Inc., the assignee of the present invention. As shown in FIGS. 1, 2 and 7, the housing 42 is adapted to be supported by the top rail 20. In a preferred embodiment, the housing 42 is designed to be flush-mounted in the top rail 20. It is understood, however, that the housing 42 could be designed to be supported in other ways by the top rail 20 such as a "top-mount" design. The latch bolt 46 is disposed within the housing 42. The actuator 48 is connected to the latch bolt 46 and is designed to retract the latch bolt 46 into the housing 42 against the biasing force of the spring 50. It is understood that in a preferred embodiment, the actuator 48 is a separate component of the tilt-latch 10 but, nevertheless, could be integrally connected, for example, to the latch bolt 46. In the most preferred embodiment of the invention, however, the separate actuator 48 is utilized.

Figure 8:
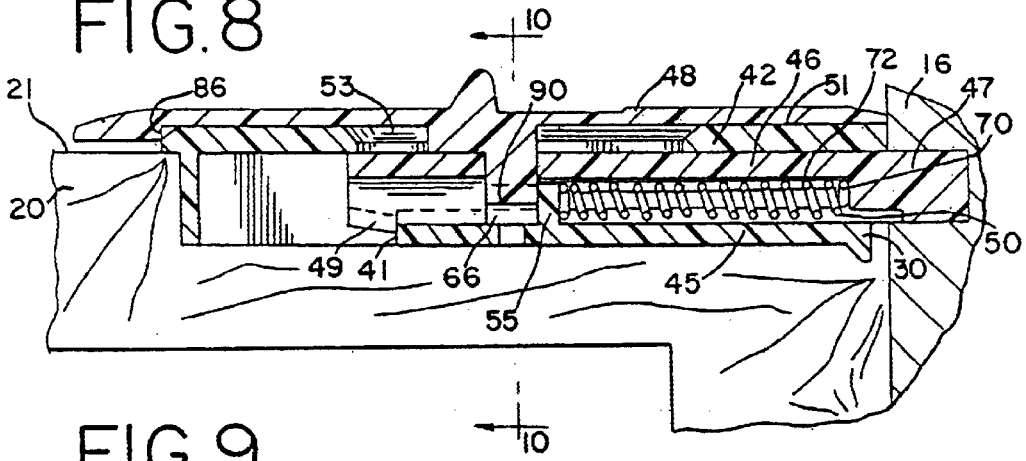
FIG. 8 is a cross-sectional view of the tilt-latch taken along lines 8—8 of FIG. 7.

As shown in FIG. 2, in a most preferred embodiment, the housing 42 generally has a box-type structure defining a chamber 43 therein. The housing 42 has a cover 51 having opposing longitudinal edges 52,54. Referring to FIGS. 2–5, a pair of sidewalls 56,58 depend from the cover 51, and in the preferred embodiment are spaced inward of the respective longitudinal edges 52,54. The housing 42 further has a bottom wall 45 (FIG. 8). If desired, the tilt-latch 10 could be designed wherein the housing 42 has an open bottom end with no bottom wall. The cover 51, sidewalls 56,58 and bottom wall 45 cooperate to form the chamber 43 within the housing 42. The housing 42 also has an outward end opening 44 in communication with the chamber 43. The housing 42 is preferably of a one-piece construction. The one-piece construction strengthens the housing 42 and simplifies assembly. The housing 42, however, could also be made from multiple pieces. In addition, while a box-type housing structure is preferred, the housing could also take other forms. For example, the housing 42 could not include the bottom wall 45 but instead include tabs to hold the latch bolt 46 in the housing 42. The spring 50 could be held any number of ways as known in the art. In a preferred embodiment of the invention, the housing is made from polymeric materials such as plastic using known injection molding processes. It is understood that any number of known plastic materials could be used. In a most preferred embodiment, the housing is made from nylon plastic. As shown in FIG. 8, the cover 51 of the housing 42 has an elongated opening 53.

Figure 4:
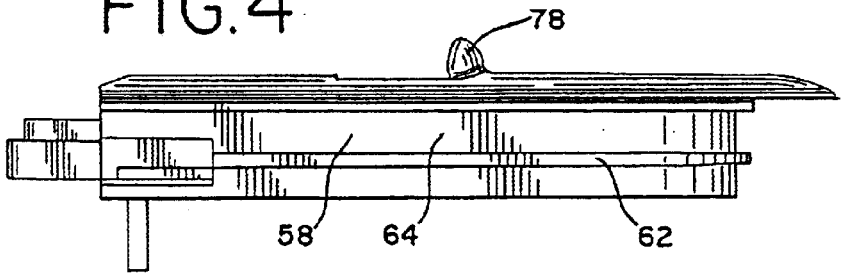
FIG. 4 is a side elevational view of the tilt-latch.
Figure 5:
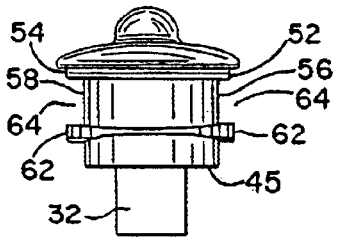
FIG. 5 is a rear end view of the tilt-latch.

As shown in FIGS. 2, 4 and 5, each of the sidewalls 56, 58 has a sidewall rail 62 which cooperates with a respective one of the housing cover longitudinal edges 52,54, to form a longitudinal groove 64 adapted to cooperatively receive a respective one of the header rails 36,38. The sidewall rail 62 could be noncontinuous and comprise a number of spaced projections to form a noncontinuous groove with the cover 51. The housing cover longitudinal edges 52,54 could also be noncontinuous although this is normally not desired for cosmetic purposes. The sidewall rail 62 could also comprise one projection at a front portion of the sidewall and another projection on a rear portion of the sidewall to form the groove 64 with the cover 51. The sidewall rail 62 can also extend completely around the rear of the housing 42 to provide greater contact with the header rails 36,38. In a wood window application, the header rails 36,38 are routed to be thicker than header rails 36,38 in a vinyl window application to make the wood header rails sufficiently robust. Consequently, the groove 64 (FIG. 4) may be wider than the groove shown, for example, in U.S. Pat. No. 5,139,291.

Figure 12:
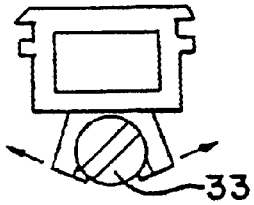
FIG. 12 is an end view of the tilt-latch showing a screw installed into the screw post.

As shown in FIG. 8, the housing 42 could include a depending tab 30 for engaging an inner surface formed in a respective one of the stiles 24,26 when installed in the sash window frame. The depending tab 30 is preferably a solid, inflexible tab to maintain the structural rigidity of the housing 42. The depending tab 30, however, could also be flexible. The housing 42 could also have a screw hole for fastening to the top rail 20 such as if the sash frame was solid. For example, a screw hole could be provided in the bottom wall 45 of the housing 42. FIGS. 2, 5, 11 and 12 show an alternative wherein the housing 42 has a depending screw post 32 typically used in a wood window application. The stile 24,26 is prepared accordingly to accommodate the screw post 32. As shown in FIG. 12, a screw 33 is then screwed through the post and into the stile 24,26 wherein the screw post 32 may split substantially down its center. It is understood that a different type of fastener could be used such as a nail, staple or staking fastener in place of the screw 33.

Figure 9:
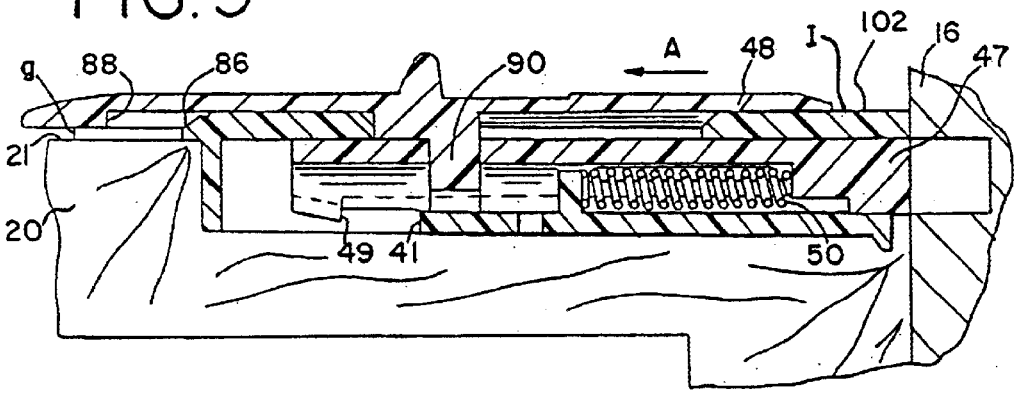
FIG. 9 is another cross-sectional view of the tilt-latch taken along lines 8—8 of FIG. 10 is a cross-sectional view of the tilt-latch taken along lines 10—10 of FIG. 8.
Figure 10:
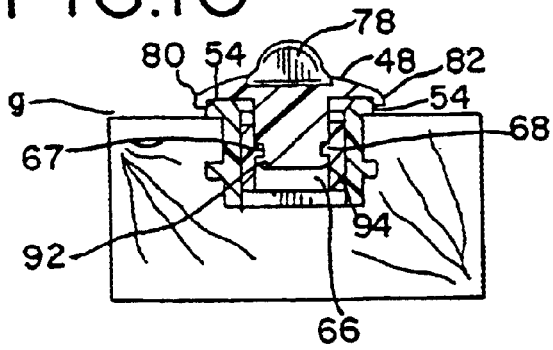
Figure 11:
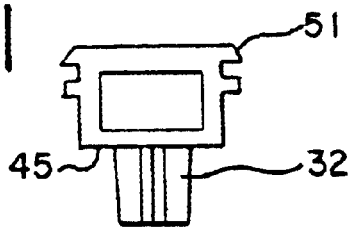
FIG. 11 is an end view of the tilt-latch showing a screw post.

As shown in FIGS. 2–4 and 8, the latch bolt 46 is disposed within the chamber 43 of the housing 42 and is adapted to slide within the housing 42. The latch bolt 46 has a nose 47 adapted for engaging a respective one of the guide rails 16. As shown in FIGS. 8 and 9, the latch bolt has a slot 66. As shown in FIG. 10, the slot has a pair of fingers 67,68 that extend into the slot 66. The slot 66 and fingers 67,68 cooperate with connecting structure on the actuator 48 as will be described in greater detail below. As shown in FIG. 8, the latch bolt 46 preferably has a spring wall 70 that is designed to engage or abut against one end of the spring 50. The latch bolt 46 has a pocket 72 that accommodates the spring 50. The spring 50 functions to bias the latch bolt 46 out of the housing 42. Preferably, as shown in FIG. 8, the spring 50 is positioned in the chamber 43 and within the pocket 72, and has one end positioned abutting the spring wall 70 and another end abutting an intermediate spring wall 55 of the housing 42 wherein the latch bolt 46 is biased through the outward end opening 44 of the housing 42. The housing 42 could have an opening cut into the bottom wall 45 that defines a stop surface 41 and the latch bolt 46 could have a hook 49 that catches on the stop surface to serve as a bolt stop, similar to the tilt-latch disclosed in U.S. Pat. No. 5,139,291. As with the housing 42, the latch bolt 46 is also preferably made from plastic although other materials are possible. In a most preferred embodiment, the latch bolt 46 is made from nylon plastic.

Figure 14:
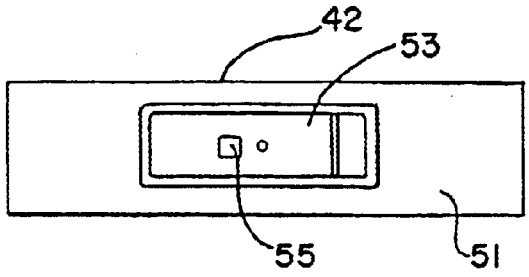
FIG. 14 is a plan view of the housing of the tilt-latch.
Figure 15:
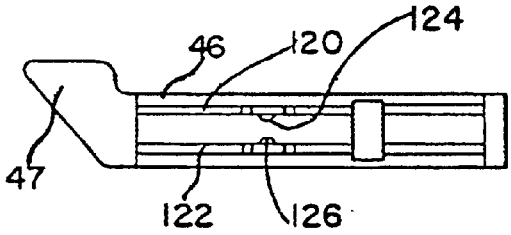
FIG. 15 is a bottom view of the latch bolt of the tilt-latch.
Figure 16:
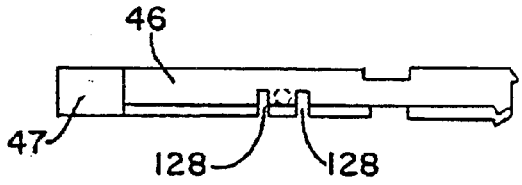
FIG. 16 is a side elevational view of the tilt-latch.
Figure 17A:
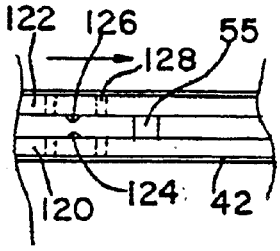
FIGS. 17*a*–17*c* are schematic views showing the latch bolt retracting into the housing and being maintained in a retracted position.
Figure 17B:
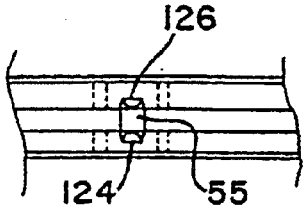
Figure 17C:
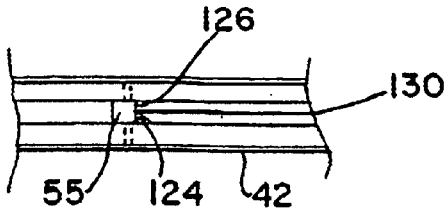
Figure 18:
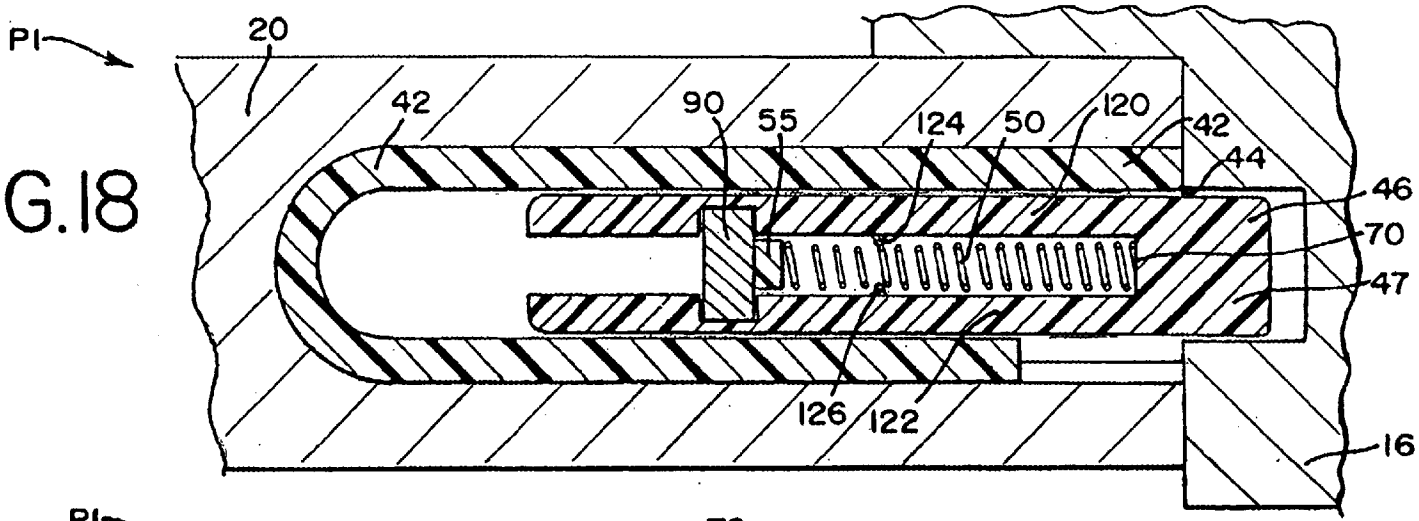
FIG. 18 is a cross-sectional view of the tilt-latch taken along line 8—8 of FIG. 7, showing the tilt-latch in a deployed position.

The housing 42 and latch bolt 46 are equipped with a cooperative mechanism to maintain the latch bolt 46 in a retracted position. FIG. 14 shows a plan view of the housing 42 wherein the intermediate spring wall 55 is shown through the elongated opening 53. The spring wall 55 is one inner wall of the housing 42. FIG. 15 shows an underside of the latch bolt 46. The latch bolt 46 has a pair of rails 120, 122. Each rail 120,122 has a protrusion 124,126 arranged inwardly and in opposing relation along the rails 120,122. Each protrusion 124,126 has a slit 128 formed in the rail 120,122 on each side of the protrusion 124,126. The protrusion 124,126 is resilient and the slits 128 improve the flexibility of the protrusions 124,126. The protrusions 124, 126 cooperate with the inner wall, or spring wall 55 to maintain the latch bolt 46 in a retracted position when the latch bolt 46 is retracted into the housing 42. This feature will be described in greater detail below.

It is noted that in a preferred embodiment of the invention, the spring 50 is a coil spring. It is understood, however, that other biasing members could also be used in place of the spring 50. For example, other types of springs can be used such as z-springs and leaf springs although coil springs are preferred. Rubber or polymeric resilient members could also be used. In addition, resilient plastic member(s) could be integrally attached to the latch bolt 46 to bias the latch bolt 46 out of the housing 42. In sum, any structure could be used that will cause the latch bolt 46 to move back and forth. It is further understood that a biasing means is not required.

The tilt-latch could be adapted for manual retraction and extension of the latch bolt 46.

Figure 6:
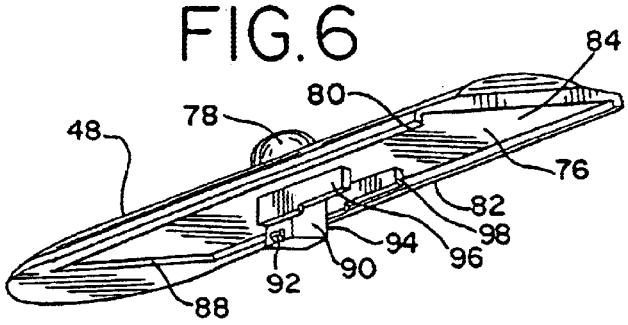
FIG. 6 is a perspective view of the tilt-latch actuator showing an underside of the actuator.

As shown in FIGS. 6, 8 and 9, the actuator 48 is generally an elongated body having a top surface 74 and an underside surface 76. A control button 78 extends from the top surface 74 and is shaped to be comfortably engaged by an operator's finger. The actuator 48 has opposed longitudinal flanges 80,82 that depend from the top surface 74. As discussed in greater detail below, the depending longitudinal flanges 80,82 are adapted to slide along the peripheral edges 52,54 of the housing cover 51 when the latch bolt 46 is retracted into the housing. The underside surface 76 has a recessed portion 84 that accommodates the cover 51 of the housing 42 when connected to the latch bolt 46. In one preferred embodiment, the cover 51 is rectangular, and the recessed portion 84 is sized to correspond to the cover 51. As shown in FIG. 8, the cover 51 has a rear transverse edge 86. The underside surface 76 has an actuator rear transverse edge 88 (FIGS. 6 and 9) that engages the rear transverse edge 86 of the housing when the actuator 48 is connected to the latch bolt 46. The actuator 48 generally has a raised cross-sectional shape to accommodate the housing structure it fits over.

As further shown in FIGS. 6, 8 and 9, the actuator 48 has a post 90 extending downwardly from the underside surface 76. The post 90 has a pair of fingers 92,94 extending from side surfaces of the post 90. A pair of ridges 96,98 depend from the underside surface 76 and extend from opposite sides of the post 90. The ridges 96,98 will rest on a top surface of the latch bolt 46.

The tilt-latch 10 is easily preassembled by first inserting the spring 50 and latch bolt 46 into housing 42 through the elongated opening 53. The spring 50 is positioned within the pocket 72 and has one end against the intermediate spring wall 55 and the other end against the spring wall 70 of the latch bolt 46 to bias the latch bolt 46 outwardly through the outward end opening 44. The actuator 48 is then placed over the cover 51 of the housing 42 wherein the post 90 passes through the elongated opening 53 and is inserted into the slot 66 of the latch bolt 46. The post 90 is snapped into the slot 66 wherein the tabs 92,94 slide past the fingers 67,68. The tabs 92,94 engage underside surfaces of the fingers 67,68 respectively (FIG. 10). The actuator 48 is then connected to the latch bolt 46. The ridges 96,98 rest on a top surface of the latch bolt 46 and help prevent any rocking of the actuator 48. As shown in FIGS. 2 and 7, the actuator 48 is sized to be positioned over the entire cover 51 of the housing 48. The flanges 80,82 are positioned over the longitudinal peripheral edges 52, 54 of the cover. The recessed portion 84 receives the cover 51 wherein the actuator 48 rests adjacent the top surface 21 of the top rail 20. A small gap may be maintained between the flanges 80,82 and the top surface 21 of the top rail 20. The actuator 48 also has a rounded rear portion 100 that extends past the rear transverse edge 86 of the cover 51. Thus, when the latch bolt 46 is in a first position biased through the outward end opening 44, the actuator 48 blankets or shrouds the cover 51 where one can only see the actuator 48. As the actuator 48 is preferably made from zinc, one viewing the window sash from either inside or outside of a room sees an aesthetically pleasing metal tilt-latch, and is not aware the remaining portions of the tilt-latch are made from plastic.

After preassembly, the tilt-latch 10 can then be installed into the sash window 12. Preferably, the tilt-latch 10 is inserted from the side into a respective one of the header slots 34, such that the pair of longitudinal grooves 64 cooperatively receive a respective pair of the header rails 36,38. The tilt-latch 10 is inserted until the depending tab 66 has engaged the inner surface of a respective one of the stiles 24,26. Alternatively, the longitudinal groove could be formed with resilient tabs/projections wherein the tilt-latch 10 could be installed by snapping the latch in from the top of the top rail 20. In addition, the entire side wall rail 62 could be beveled to allow snap insertion from the top of the top rail 20. Regardless of the specific method of insertion into the top rail 20, once installed, the longitudinal grooves 64 cooperatively receive the header rails 36,38 and support the tilt-latch in the top rail 20. In addition, as alternatively shown in FIGS. 11 and 12, the screw post 32 could be used instead of the tab 30. A screw 33 would be screwed into the post 32 and into a respective one of the stiles 24,26. It is further understood that the housing 42/spring 50/latch bolt 46 subassembly could be pre-assembled first and installed into the top rail and then the actuator 48 could subsequently be connected to the latch bolt 46.

FIGS. 7–9 show the tilt-latch 10 installed in the top rail 20. An underside of the cover 51 rests on the top surfaced 21 of the top rail 20. The actuator 48 blankets the cover 51 and rests above the top surface 21 of the top rail 20. As shown in FIGS. 9 and 10, a gap "g" is maintained between the flanges 80, 82 of the top surface 21 of the top rail 20. The actuator 48 extends from a leading edge surface of the stile 24,26 to an area past the housing 42. To actuate the tilt-latch 10, an operator's finger engages the control button 78 and pulls back on the actuator 48 wherein the actuator 48 moves in the direction of arrow A. As the actuator 48 is connected to the latch bolt 46, the latch bolt 46 is retracted into the housing 42 as shown in FIG. 9. When the actuator 48 retracts the latch bolt 46 into the housing 42, the flanges 80,82 of the actuator 48 slide along the peripheral edges 52,54 of the cover 51. As shown in FIG. 9, the gap g is maintained even when the latch bolt is retracted thereby preventing any scraping damage of the top surface 21 of the top rail. As further shown in FIGS. 7–9, the housing 42 is adapted for substantially flush installation in the top rail 20 wherein the cover 51 is positioned on the top surface 21 of the top rail 20. When the actuator 48 retracts the latch bolt 46, the actuator 48 slides along the cover 51 exposing a front segment 102 of the cover 51 (FIG. 9). The actuator 48 slides along the top surface 21 of the top rail 20, but does not contact the top surface 21. By retracting the latch bolts 46 of each respective tilt-latch 10 simultaneously, the sash window 12 can be tilted from the master frame.

As shown in FIGS. 14–17, the housing 42 and latch bolt 46 have a cooperative mechanism to maintain the latch bolt 46 in a retracted position. As discussed, the latch bolt has an extended position (FIG. 8) wherein the spring 50 biases the latch bolt 46 through the outward end opening 44. FIG. 17*a* shows a schematic view of this latch bolt 46 wherein the protrusions 124,126 are spaced from the inner wall or spring wall 55 of the housing 42. When the latch bolt 46 is retracted into the housing 42, the protrusions 124,126 advance towards the inner wall 55. As shown in FIG. 17*b*, the protrusions 124,126 flex around side walls of the inner wall until they pass the inner wall 55 as shown in FIG. 17*c*. The resilient protrusions 124,126 snap back and engage a back surface 130 of the inner wall 55. This engagement maintains the latch bolt 46 in a retracted position even against the biasing force of the spring 50. To return the latch bolt 46 to its extended position, an operator must engage the actuator 48 to move the latch bolt 46 to the extended position wherein the protrusions 124,126 pass back over the inner wall 55. In certain applications, operators prefer to be able to maintain the latch bolts 46 in a retracted position. It is understood that the protrusion/wall structure could be reversed between the housing 42 and the latch bolt 46.

Figure 13:
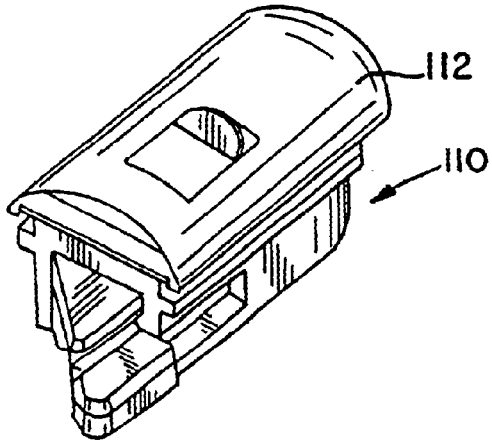
FIG. 13 is a perspective view of an alternative tilt-latch of the present invention.

FIG. 13 shows an alternative embodiment of the tilt-latch 10 of the present invention wherein an actuator 110 is shorter in length to correspond in size to a smaller cover 112. This type shorter type of tilt-latch, shown with a different actuator, is disclosed in U.S. Pat. No. 6,155,615.

The design and structure of the tilt-latch 10 of the present invention provide a number of advantages. As discussed, in a most preferred embodiment, the housing 42 and latch bolt 46 are made from nylon plastic and the actuator 48 is made from zinc. Because the actuator 48 covers the entire housing 42, when installed in a sash window, only the actuator 48 is viewable. The tilt-latch structure below the actuator 48 is hidden from view under the actuator 48. This feature makes the tilt-latch 10 particularly suitable for installation in a wood window, or simulated wood window where metal hardware is aesthetically preferred. While obtaining these aesthetic benefits, the substantial remainder of the tilt-latch 10 (e.g. housing 42 and latch bolt 46) can be made from nylon plastic. This material is less expensive, saving on material costs. The operation between the latch bolt 46 and housing 42 is also smother and quieter than if all zinc materials were used. The plastic latch bolt 46 also minimizes the risk of damaging sash frame components including trim, stiles, or the sash frame guide rails when the latch bolt nose 47 engages outer surfaces of the guide rails such as when the sash window 12 is pivoted to a closed position. In addition, with the actuator sized to completely cover the housing 42, additional housing structures are possible. For example, a housing could be provided without a cover 51 if desired. Also, a generic housing 42/latch bolt 46 subassembly could be provided with actuators 48 of several different colors to match a variety of different wood windows. The actuator 48 could also be plated if desired. While the most preferred embodiment contemplates a zinc actuator, it is understood that the actuator 48 could also be made from plastic. It is further understood that regardless of the materials used to construct the tilt-latch components, the tilt-latch 10 can be used in solid wood windows, simulated wood windows or even traditional vinyl windows having PVC extrusions, with a zinc actuator or plastic actuator.

Figure 19:
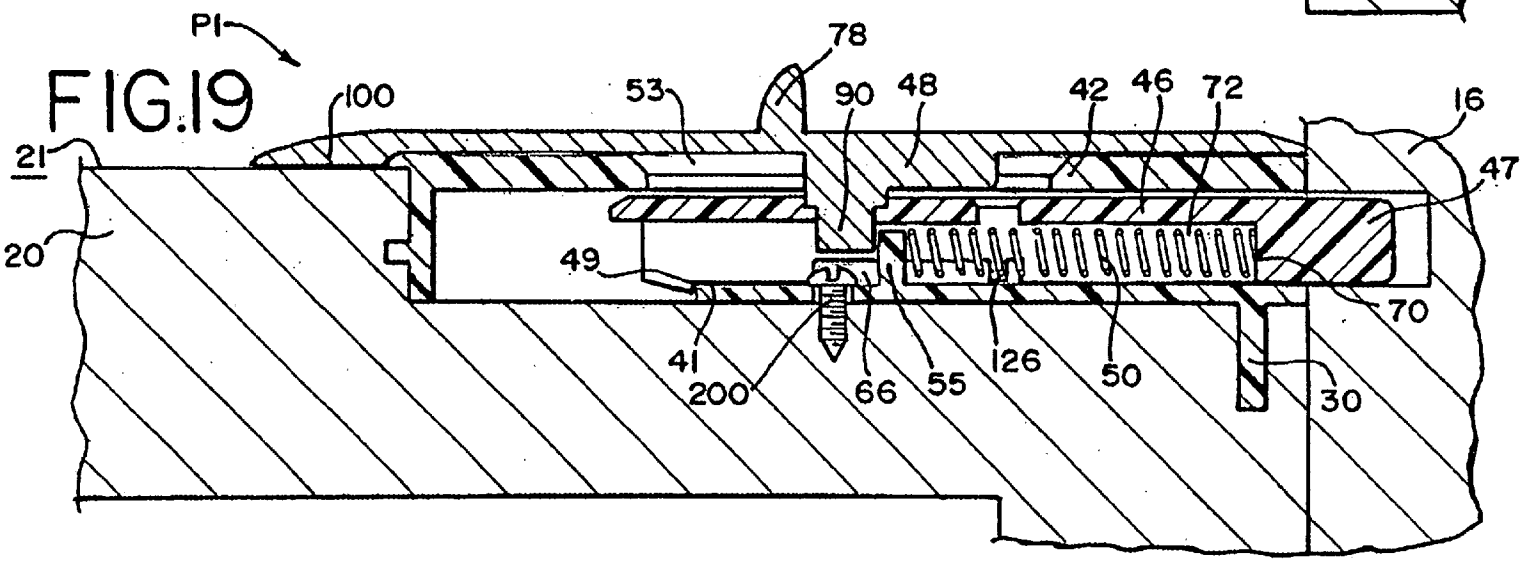
FIG. 19 is a cross-sectional view of the tilt-latch taken along line 19—19 of FIG. 7, showing the tilt-latch in the deployed position.

Referring to FIGS. 17–23, the progression of the latch bolt 46 from an extended or deployed position P1 through an intermediate position P2 to a retracted position P3 is depicted. In the deployed position P1 shown in FIGS. 18 and 19, the spring 50 is positioned generally between the rails 120, 122 of the latch bolt 46. The spring 50 exerts a force on the wall 70 of the latch bolt 46 causing the nose 47 of the latch bolt 46 to extend past the outward opening 44 of the housing 42. As a result, the projections 124, 126 of the latch bolt 46 are positioned a distance from the inner wall 55. Described in a different manner, neither of the projections 124, 126 make contact with the inner wall 55 when the latch bolt 46 is in the deployed position P1 (see also FIG. 17*a*). In the deployed position P1, the post 90 of the actuator 48 is positioned adjacent the inner wall 55. Referring to FIG. 19, a fastener 200 is positioned below the post 90 and extends through an opening in the bottom wall of the housing 42 to further secure the tilt latch 10 to the top sash rail 20. The fastener 200 is adapted to not interfere with the movement of the post 90 during movement of the actuator 48.

Figure 20:
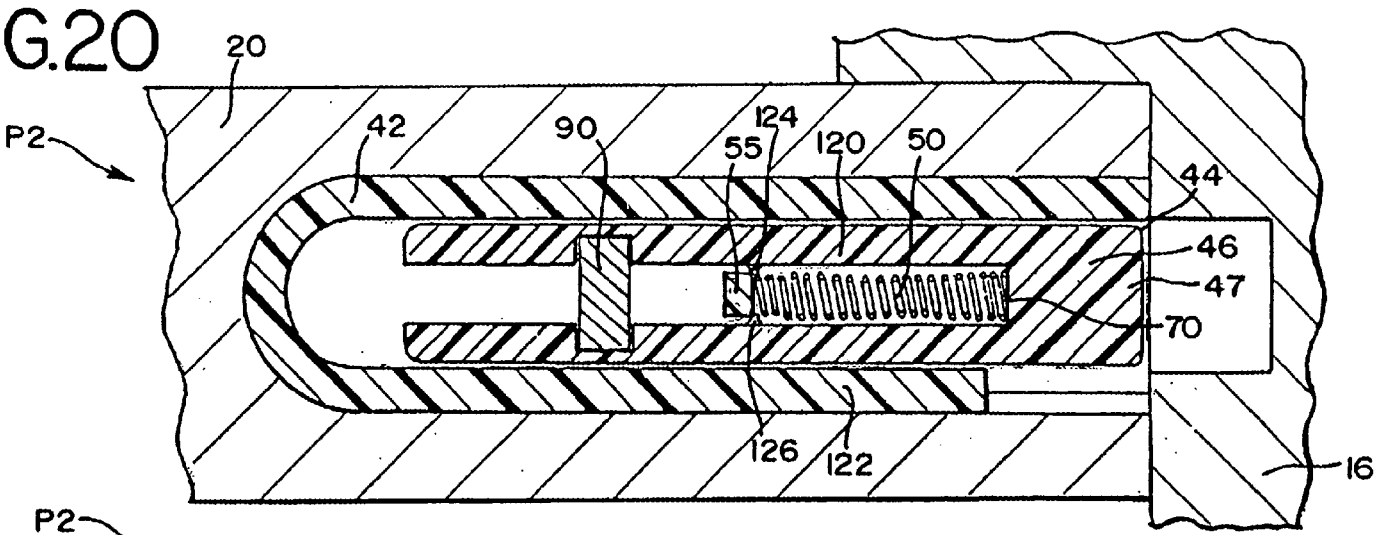
FIG. 20 is a cross-sectional view of the tilt-latch taken along line 8—8 of FIG. 7, showing the tilt-latch in an intermediate position.
Figure 21:
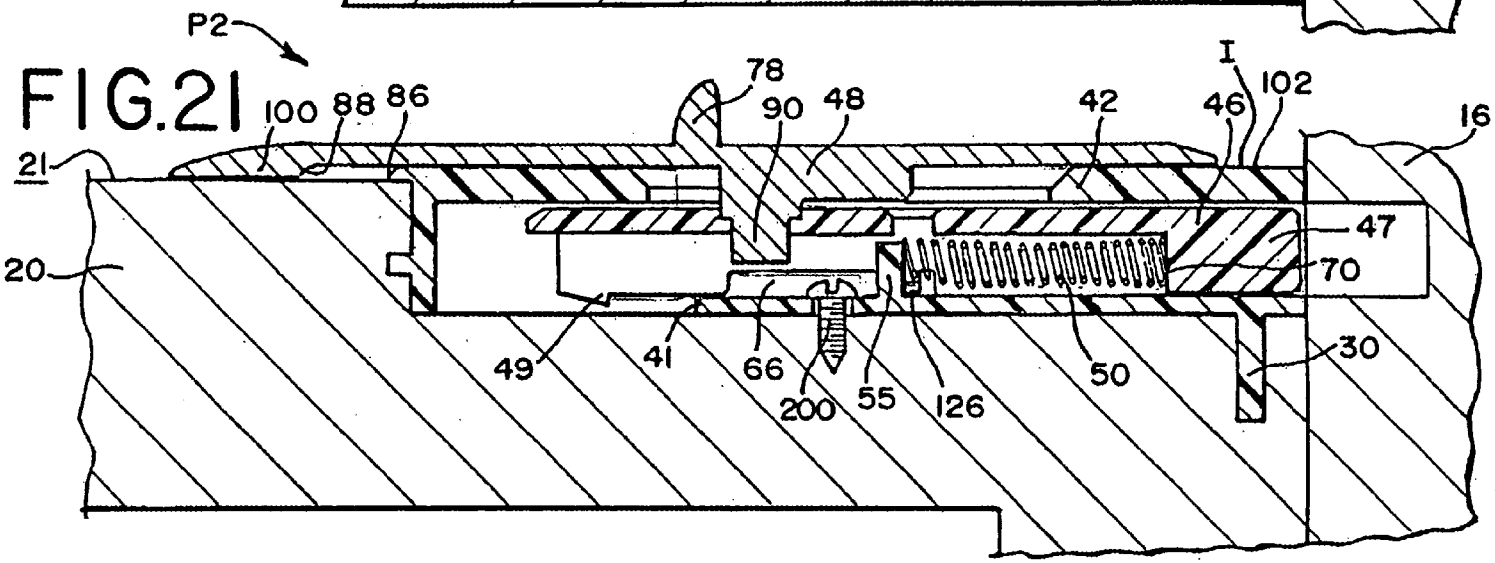
FIG. 21 is a cross-sectional view of the tilt-latch taken along line 19—19 of FIG. 7, showing the tilt-latch in the intermediate position.
Figure 22:
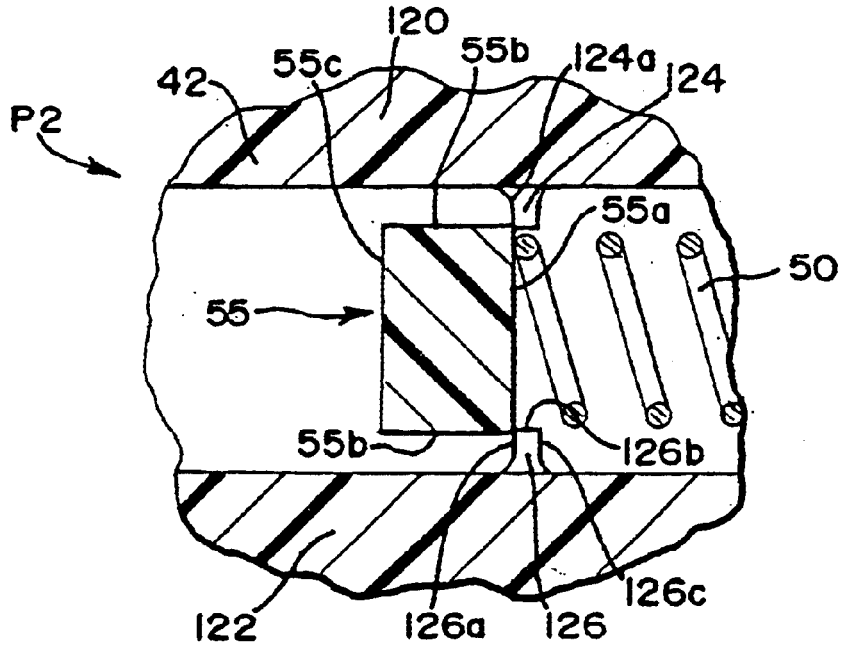
FIG. 22 is a close-up view of FIG. 21, showing the engagement between a pair of protrusions and an inner wall.

In the intermediate position P2 shown in FIGS. 20–22, the actuator 48 is retracted an amount causing the spring 50 to partially compress and the nose 47 of the latch bolt 46 is generally coincident with the outward opening 44. As a result, a portion of the projections 124, 126 engage a portion of the inner wall 55 (see also FIG. 17*b*). Referring to FIG. 22, a first portion 124*a*, 126*a* of the projections 124, 126 engages a leading edge 55*a* of the inner wall 55. Since the latch bolt 46 has two projections 124, 126, the first projection 124 engages a first portion of the leading edge 55*a* and the second projection 126 engages a second portion of the leading edge 55*a*—in this manner, the projections 124, 125 engage opposite or opposed portions of the leading edge 55*a*. As additional force is applied to the actuator 48 to further retract the latch bolt 46, the protrusions 124, 126 flex thereby permitting the protrusions 124, 126 to clear or move past the leading edge 55*a* of the wall 55. This means that the protrusions 124, 126 deflect or partially deform to overcome the engagement with the leading edge 55*a*. Once the protrusions 124, 126 have deflected or deformed a sufficient amount to overcome the leading edge 55*a*, an upper portion 124*b*, 126*b* (see FIG. 26) of the protrusions 124, 126 slidingly engage a pair of peripheral edges or surfaces 55*b* of the inner wall 55. Provided that additional retracting force is applied to the actuator 48, the protrusions 124, 126 move from the leading edge 55*a* to the trailing edge 55*c* while slidingly engaging the peripheral edges 55*b*. This means that the protrusions 124, 126 slidingly engage opposed portions of the peripheral edges 55*b* when the latch bolt 46 moves between the intermediate position P2 and retracted position P3. In the intermediate position P2, latch bolt 46 is retracted, however, the tilt-latch 10 is not locked or fixed. Consequently, the spring 50 can bias the latch bolt 46 to the deployed position P1 in the event an operator releases the actuator 48.

Figure 25:
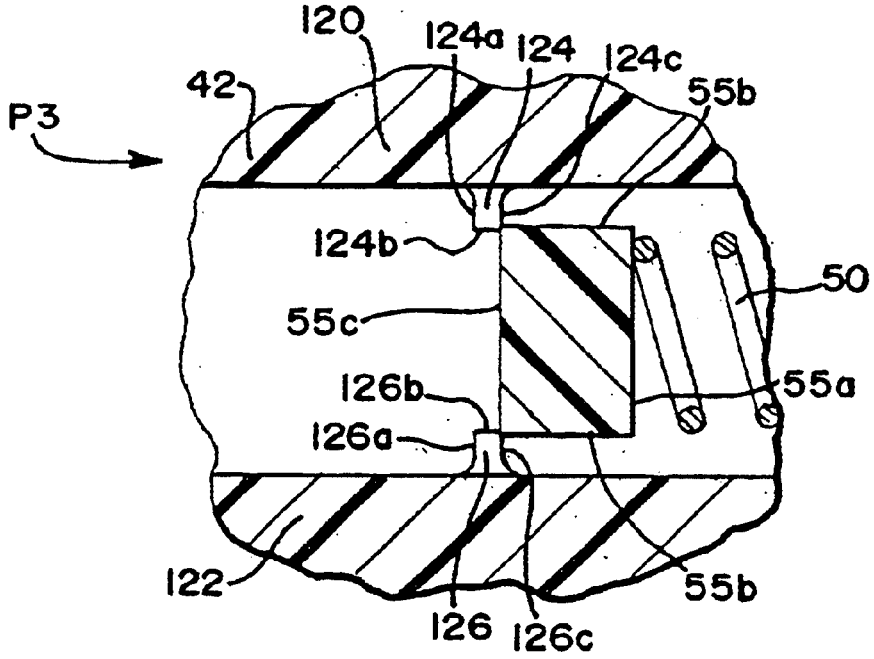
Figure 23:
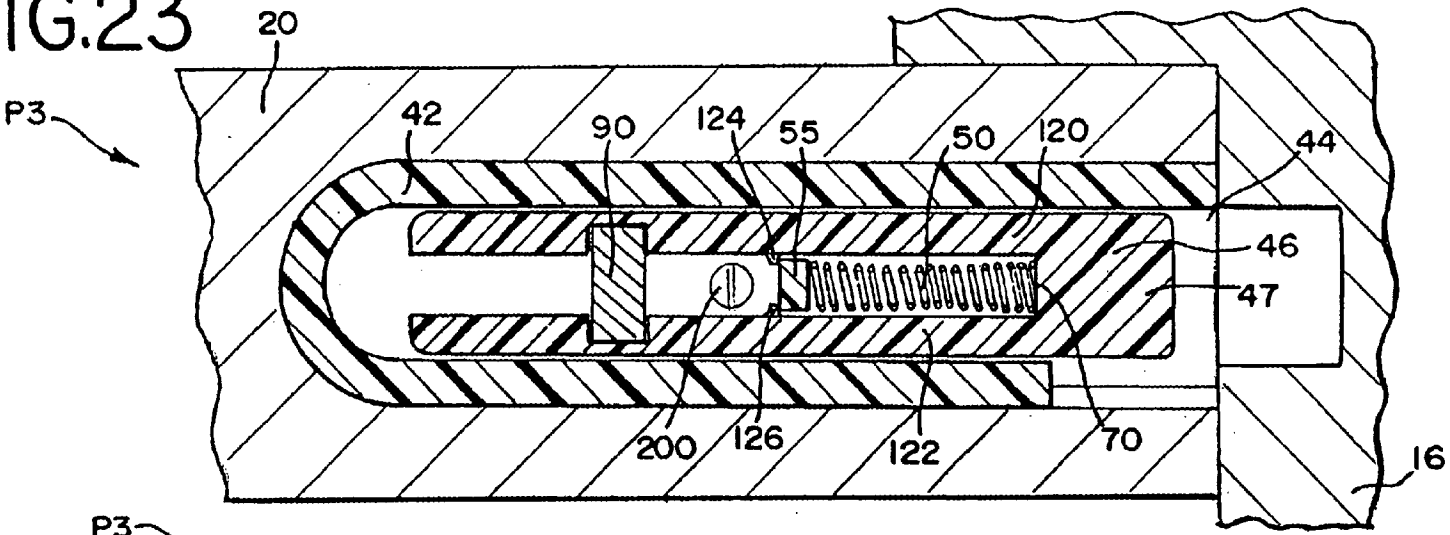
FIG. 23 is a cross-sectional view of the tilt-latch taken along line 8—8 of FIG. 7, showing the tilt-latch in a retracted position.
Figure 24:
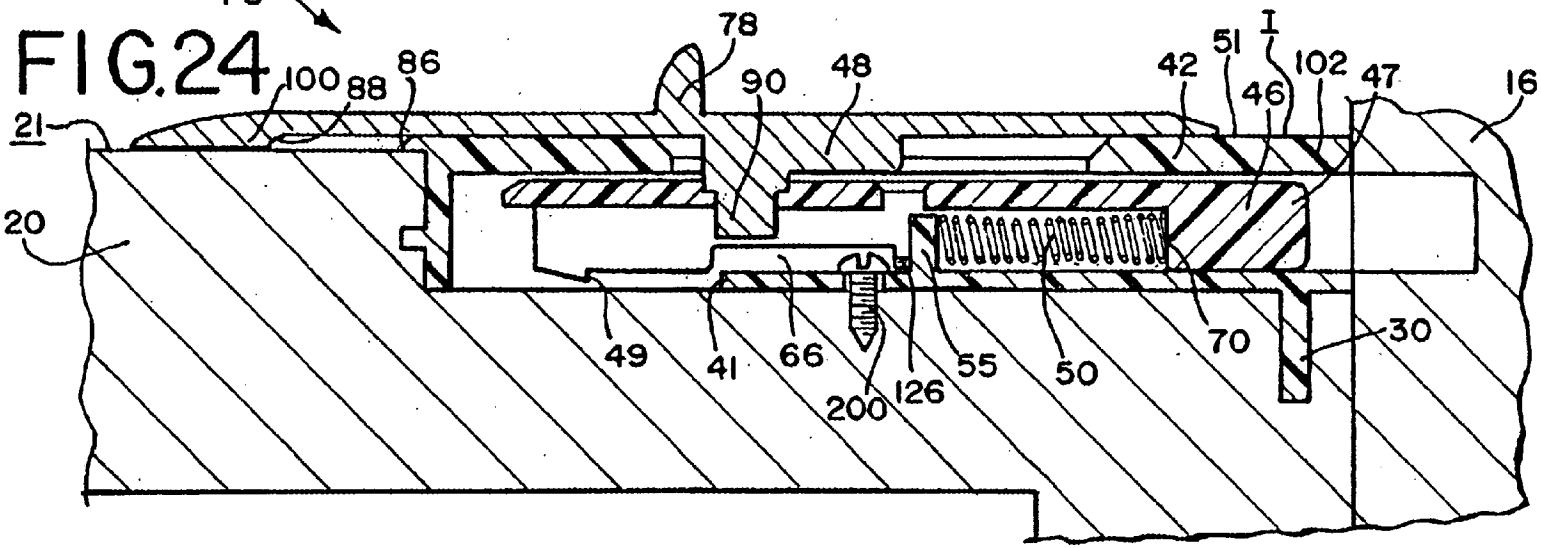
FIG. 24 is a cross-sectional view of the tilt-latch taken along line 19—19 of FIG. 7, showing the tilt-latch in the retracted position; and, FIG. 25 is a close-up view of FIG. 23, showing the engagement between the protrusions and the inner wall.

In the retracted position P3 shown in FIGS. 23-24, the actuator 48 is further retracted (compared to the intermediate position P2) causing the spring 50 to fully compress and the nose 47 of the latch bolt 46 is positioned within the housing 42. Referring to FIG. 25, a second portion 124*c*, 126*c* of the projections 124, 126 engages the trailing edge 55*c* of the inner wall 55. Since the latch bolt 46 has two projections 124, 126, the first projection 124 engages a first portion of the trailing edge 55*c* and the second projection 126 engages a second portion of the trailing edge 55*c*—in this manner, the projections 124, 125 engage opposite or opposed portions of the trailing edge 55*c*. The projections 124, 126 reach this position after the first portions 124*a*, 126*a* of the projections 124, 126 clear or move past the trailing edge 55*c*. In the retracted position P3, the projections 124, 126 are preferably not deflected or deformed in the manner described above with respect to the intermediate position P2. In the retracted position P3, the engagement between the projections 124, 126 and the inner wall 55 secures the latch bolt 46 in a retracted position (see also FIG. 17*c*). Consequently, the spring 50 cannot bias the latch bolt 46 to the deployed position P1 in the event an operator releases the actuator 48. However, the operator can apply force to the actuator 48 to overcome the engagement between the projections 124, 126 and the inner wall 55 and move the latch bolt 46 from the retracted position P3 to either the intermediate position P2 or the deployed position P1. When the operator applies a sufficient amount of force to the actuator 48, the protrusions 124, 126 deflect thereby permitting the protrusions 124, 126 to move past the trailing edge 55*c* of the wall 55 and slidingly engage the peripheral edge 55*b* of the inner wall 55. Consistent with the above disclosure, the spring 50 biases the latch bolt 46 to the deployed position P1 wherein the protrusions 124, 126 do not engage the inner wall (see FIGS. 18 and 19).

As discussed above, the protrusions 124, 126 are adapted to deflect or deform to overcome the engagement with the leading edge 55*a* and the trailing edge 55*c* of the inner wall 55. Preferably, the first portions 124*a*, 126*a* and the second portions 124*c*, 126*c* have a curvilinear configuration, and the top portion 124*b*, 126*b* has a generally linear configuration. Alternatively, the first and second portions a, b have a linear configuration; however, such configuration does not prevent the protrusions 124, 126 from deflecting or deforming. In addition, the degree or amount of deformation of the protrusions 124, 126 varies with the design parameters of the tilt-latch 10, including but not limited to the geometry and material composition of the inner wall 55 and the protrusions 124, 126 themselves.

Although two distinct protrusions 124, 126 are discussed and shown in the Figures, it is understood that the latch bolt 46 can have a single protrusion. In this configuration, the latch bolt 46 and single protrusion would operate in a manner consistent with the foregoing disclosure. As disclosed above, the housing 42 has the inner wall 55 and the latch bolt 46 has the projections 124, 126. Alternatively, the housing 42 has the projections 124, 126 and the latch bolt 46 has the inner wall 55. In this configuration, the latch bolt 46 and the inner wall 55 are moveable with respect to the generally fixed housing 42 and projections 124, 126.

FIGS. 19, 21, and 23 illustrate another aspect of the invention wherein the housing 42 includes means for indicating the status of the tilt-latch 10. In general terms, the indicating means (I) provides visual indication of the position of the latch bolt 46, such as an indication that the latch bolt 46 is in the retracted position. It is understood that the retracted position can encompass positions wherein the nose of the latch bolt 46 is partially within the housing 42 or entirely within the housing 42. The indicating means (I) can be indicia, such as a letter, number or other symbol, that is positioned or marked on the cover 51 of the housing 42, preferably on a front segment 102 of the cover 51. Alternatively, the indicating means can be a color-coded portion or segment of the cover 51. For example, the indicating means can have a green color-coding to reflect that the latch bolt 46 is in the retracted position P3 and the sash window 12 is capable of being tilted. The color-coded indicating means can be fabricated during the molding process of the housing 42 thereby integrating the steps of forming the indicating means and the housing 42. In addition, the entire housing 42 may be molded in a color that is visually distinct, or perceptively different, from a color of the actuator 48. In sum, and in one preferred form of the invention, the front segment 102 may comprise the indicating means by possessing indicia or a visually distinct color.

When the latch bolt 46 is in the deployed position P1 (see FIG. 19), the indicating means on the front segment 102 is not visible because it is generally obscured from view by the actuator 48. When force is applied to the actuator 48 to retract the latch bolt 46 to the intermediate position P2 (see FIG. 21), a first portion of the indicating means is visible since the actuator 48 has been retracted thereby exposing a portion of the front segment 102 of the cover 51. When additional force is applied to the actuator 48 to retract the latch bolt 46 to the retracted position P3 (see FIGS. 23 and 24), a second portion of the indicating means is visible since the actuator 48 has been further retracted thereby exposing a greater amount of the front segment 102. When the latch bolt 46 is in the retracted position P3, an operator can view the front segment 102 to indicate the position of the latch bolt. In one preferred embodiment, the front segment 102 of the housing 42 has a first color and the actuator 48 has a second color visually distinct, or perceptively different from the first color. When the latch bolt 46 is in an extended position (i.e. the first position of the actuator 48, see FIG. 7), the first color is not visible or generally obscured by the actuator 48. When the actuator 48 is moved to its second position to retract the latch bolt 46 into the housing 42 such as shown in FIGS. 9 and 24, the first color is visible thus indicating that the latch bolt 46 is in the retracted position.

While the specific embodiments have been illustrated and described, numerous modifications come to mind without significantly departing from the spirit of the invention and the scope of protection is only limited by the scope of the accompanying claims.

We claim:

1. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and an inner wall;

a latch bolt disposed within the housing, the latch bolt having a nose adapted for engaging a respective one of the guide rails, the latch bolt further having a first protrusion, the latch bolt having a second protrusion positioned generally opposite the first protrusion; and, wherein the latch bolt is moveable between a deployed position wherein the nose extends through the outward end opening and the first protrusion is spaced from the inner wall, and a retracted position wherein the first protrusion and the second protrusion engage a trailing edge of the inner wall to maintain the latch bolt in the retracted position.

2. The tilt-latch of claim 1 further comprising a spring adapted to bias the latch bolt through the outward end opening.

3. The tilt-latch of claim 2 wherein the spring is positioned between the inner wall and a spring wall of the latch bolt.

4. The tilt-latch of claim 1 further comprising an actuator, the actuator having a post that is received by a slot in the latch bolt.

5. The tilt-latch of claim 4 wherein the housing is adapted for substantially flush installation in the top rail and wherein the actuator slides along a top surface of the top rail when the latch bolt is retracted into the housing.

6. The tilt-latch of claim 1 wherein the first protrusion is integrally formed with the latch bolt.

7. The tilt-latch of claim 1 wherein the first protrusion is resilient.

8. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and an inner wall;

a latch bolt disposed within the housing, the latch bolt having a nose adapted for engaging a respective one of the guide rails, the latch bolt further having at least one protrusion; and, wherein the latch bolt is moveable between a deployed position wherein the nose extends through the outward end opening and the protrusion is spaced from the inner wall, an intermediate position wherein the protrusion engages a leading edge of the inner wall, and a retracted position wherein the protrusion engages a trailing edge of the inner wall to maintain the latch bolt in the retracted position;

wherein the protrusion deflects when the latch bolt moves between the intermediate position and deployed position.

9. The tilt-latch of claim 8 wherein the protrusion deflects when moved between the leading edge and the trailing edge of the inner wall.

10. The tilt-latch of claim 8 wherein the inner wall has a peripheral edge positioned between the leading and trailing edges.

11. The tilt-latch of claim 10 wherein the protrusion slidingly engages the peripheral edge when the latch bolt moves between the intermediate and deployed positions.

12. The tilt-latch of claim 10 wherein the protrusion slidingly engages the peripheral edge when moved between the leading edge and the trailing edge.

13. The tilt-latch of claim 10 wherein the protrusion deflects to permit a first portion of the protrusion to clear the leading edge of the inner wall when the latch bolt moves from the intermediate position to the retracted position.

14. The tilt-latch of claim 13 the protrusion has an upper portion that slidingly engages the peripheral edge when the latch bolt moves from the intermediate position to the retracted position.

15. The tilt-latch of claim 10 wherein the protrusion deflects to permit a second portion of the protrusion to clear the trailing edge of the inner wall when the latch bolt moves from the retracted position to the intermediate position.

16. The tilt-latch of claim 15 wherein the protrusion has an upper portion that slidingly engages the peripheral edge when the latch bolt moves from the retracted position to the intermediate position.

17. The tilt-latch of claim 13 wherein the first portion of the protrusion has a generally curvilinear configuration.

18. The tilt-latch of claim 15 wherein the second portion of the protrusion has a generally curvilinear configuration.

19. The tilt-latch of claim 12 wherein the peripheral edge has a generally linear configuration.

20. The tilt-latch of claim 8 further comprising means for biasing the latch bolt through the outward end opening.

21. The tilt-latch of claim 8 further comprising an actuator, the actuator having a post that is received by a slot in the latch bolt.

22. The tilt-latch of claim 21 wherein the housing is adapted for substantially flush installation in the top rail and wherein the actuator slides along a top surface of the top rail when the latch bolt is retracted into the housing.

23. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and an inner wall;

a latch bolt disposed within the housing, the latch bolt having a nose adapted for engaging a respective one of the guide rails, the latch bolt further having a first protrusion and a second protrusion; and, wherein the latch bolt is moveable between a deployed position wherein the nose extends through the outward end opening and the protrusions are spaced from the inner wall, an intermediate position wherein the protrusions engage a leading edge of the inner wall, and a retracted position wherein the protrusions engage a trailing edge of the inner wall to maintain the latch bolt in the retracted position.

24. The tilt-latch of claim 23 the first and second protrusions engage opposed portions of the leading edge in the intermediate position.

25. The tilt-latch of claim 23 the first and second protrusions engage opposed portions of the trailing edge in the retracted position.

26. The tilt-latch of claim 23 the inner wall has a pair of peripheral edges positioned between the leading and trailing edges.

27. The tilt-latch of claim 26 wherein the first and second protrusions slidingly engage opposed portions of the peripheral edge when the latch bolt moves between the intermediate and retracted positions.

28. The tilt-latch of claim 23 further comprising means for biasing the latch bolt through the outward end opening.

29. The tilt-latch of claim 23 further comprising an actuator, the actuator having a post that is received by a slot in the latch bolt.

30. The tilt-latch of claim 29 wherein the housing is adapted for substantially flush installation in the top rail and wherein the actuator slides along a top surface of the top rail when the latch bolt is retracted into the housing.

31. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and an inner wall;

a latch bolt disposed within the housing and having a nose adapted for engaging a respective one of the guide rails, the latch bolt further having a first protrusion and a second protrusion positioned generally opposite the first protrusion; and, wherein the latch bolt has an extended position wherein the nose of the latch bolt extends through the outward end opening and wherein the protrusions are spaced from the wall, and wherein the latch bolt has a retracted position wherein the protrusions engage the wall to maintain the latch bolt in the retracted position.

32. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening, the housing further having one of an inner wall and a protrusion;

a latch bolt disposed within the housing and having a nose adapted for engaging a respective one of the guide rails, the latch bolt further having the other of the inner wall and the protrusion; wherein the latch bolt has an extended position wherein the nose of the latch bolt extends through the outward end opening and wherein the protrusion is spaced from the wall, and wherein the latch bolt has a retracted position wherein the protrusion engages the wall to maintain the latch bolt in the retracted position; and means for visually indicating that the latch bolt is in the retracted position, wherein the means for visually indicating is a color indication.

33. The tilt-latch of claim 32 wherein the housing has a first color and the actuator has a second color perceptively different than the first color, wherein the first color is visible when the latch bolt is in the retracted position.

34. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and a cover;

a latch bolt disposed within the housing and having a nose adapted for engaging a respective one of the guide rails;

an actuator connected to the latch bolt and configured to be slidingly positioned over the entire cover, the actuator moveable between a first position wherein the nose of the latch bolt extends through the outward end opening and a second position wherein the nose of the latch bolt is retracted into the housing; and, wherein the housing has means for indicating the position of the latch bolt and wherein the indicating means is generally obscured when the actuator is in the first position and is generally visible when the actuator is in the second position.

35. The tilt-latch of claim 34 wherein the indicating means is indicia positioned on a cover of the housing.

36. The tilt-latch of claim 34 wherein the indicating means is a color indication.

37. The tilt-latch of claim 36 wherein a front segment of the cover of the housing has a first color and the actuator has a second color visually distinct from the first color, wherein the first color is visible when the actuator is in the second position.

38. The tilt-latch of claim 35 wherein the indicia is a numeral.

39. The tilt-latch of claim 35 wherein the indicia is a letter.

40. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and a cover;

a latch bolt disposed within the housing and having a nose adapted for engaging a respective one of the guide rails;

an actuator connected to the latch bolt and configured to be slidingly positioned over the entire cover, the actuator moveable between a first position wherein the latch bolt is in an extended position and a second position wherein the latch bolt is in a retracted position; and, means for visually indicating that the latch bolt is in the retracted position.

41. The tilt-latch of claim 40 wherein the means for visually indicating is a color indication.

42. The tilt-latch of claim 41 wherein the housing has a first color and the actuator has a second color perceptively different than the first color, wherein the first color is visible when the latch bolt is in the retracted position.

43. The tilt-latch of claim 40 wherein the means for visually indicating is an indicia positioned on the cover of the housing.

44. The tilt-latch of claim 43 wherein the indicia is a numeral.

45. The tilt-latch of claim 43 wherein the indicia is a letter.

46. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and a cover;

a latch bolt disposed within the housing and having a nose adapted for engaging a respective one of the guide rails;

an actuator connected to the latch bolt and configured to be slidingly positioned over the entire cover, the actuator moveable between a first position wherein the nose of the latch bolt extends through the outward end opening and a second position wherein the latch bolt is retracted into the housing; and, wherein the cover has a first color and the actuator has a second color visually distinct from the first color, wherein the first color is visible when the actuator is in the second position to indicate the latch bolt is in a retracted position.

47. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and an inner wall;

a latch bolt disposed within the housing, the latch bolt having a nose adapted for engaging a respective one of the guide rails, the latch bolt further having at least one resilient protrusion; and, wherein the latch bolt is moveable between a deployed position wherein the nose extends through the outward end opening and the protrusion is spaced from the inner wall, and a retracted position wherein the protrusion engages a trailing edge of the inner wall to maintain the latch bolt in the retracted position.

48. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and an inner wall;

a latch bolt disposed within the housing, the latch bolt having a nose adapted for engaging a respective one of the guide rails, the latch bolt further having at least one protrusion; and, an actuator, the actuator having a post that is received by a slot in the latch bolt;

wherein the latch bolt is moveable between a deployed position wherein the nose extends through the outward end opening and the protrusion is spaced from the inner wall, and a retracted position wherein the protrusion engages a trailing edge of the inner wall to maintain the latch bolt in the retracted position, wherein the housing is adapted for substantially flush installation in the top rail and wherein the actuator slides along a top surface of the top rail when the latch bolt is retracted into the housing.

49. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and an inner wall;

a latch bolt disposed within the housing, the latch bolt having a nose adapted for engaging a respective one of the guide rails, the latch bolt further having at least one protrusion; and, wherein the latch bolt is moveable between a deployed position wherein the nose extends through the outward end opening and the protrusion is spaced from the inner wall, an intermediate position wherein the protrusion engages a leading edge of the inner wall, and a retracted position wherein the protrusion engages a trailing edge of the inner wall to maintain the latch bolt in the retracted position, wherein the protrusion deflects when moved between the leading edge and the trailing edge of the inner wall.

50. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and an inner wall;

a latch bolt disposed within the housing, the latch bolt having a nose adapted for engaging a respective one of the guide rails, the latch bolt further having at least one protrusion; and, wherein the latch bolt is moveable between a deployed position wherein the nose extends through the outward end opening and the protrusion is spaced from the inner wall, an intermediate position wherein the protrusion engages a leading edge of the inner wall, and a retracted position wherein the protrusion engages a trailing edge of the inner wall to maintain the latch bolt in the retracted position, wherein the inner wall has a peripheral edge positioned between the leading and trailing edges, and wherein the protrusion deflects to permit a first portion of the protrusion to clear the leading edge of the inner wall when the latch bolt moves from the intermediate position to the retracted position.

51. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and an inner wall;

a latch bolt disposed within the housing, the latch bolt having a nose adapted for engaging a respective one of the guide rails, the latch bolt further having at least one protrusion; and, wherein the latch bolt is moveable between a deployed position wherein the nose extends through the outward end opening and the protrusion is spaced from the inner wall, an intermediate position wherein the protrusion engages a leading edge of the inner wall, and a retracted position wherein the protrusion engages a trailing edge of the inner wall to maintain the latch bolt in the retracted position;

wherein the inner wall has a peripheral edge positioned between the leading and trailing edges, and wherein the protrusion deflects to permit a second portion of the protrusion to clear the trailing edge of the inner wall when the latch bolt moves from the retracted position to the intermediate position.

52. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and an inner wall;

a latch bolt disposed within the housing, the latch bolt having a nose adapted for engaging a respective one of the guide rails, the latch bolt further having at least one protrusion; and, an actuator, the actuator having a post that is received by a slot in the latch bolt; and wherein the latch bolt is moveable between a deployed position wherein the nose extends through the outward end opening and the protrusion is spaced from the inner wall, an intermediate position wherein the protrusion engages a leading edge of the inner wall, and a retracted position wherein the protrusion engages a trailing edge of the inner wall to maintain the latch bolt in the retracted position, and wherein the housing is adapted for substantially flush installation in the top rail and wherein the actuator slides along a top surface of the top rail when the latch bolt is retracted into the housing.

* * * * *

UNITED STATES PATENT AND TRADEMARK OFFICE

CERTIFICATE OF CORRECTION

PATENT NO. : 6,832,792 B2
APPLICATION NO. : 10/219059
DATED : December 21, 2004
INVENTOR(S) : Allen D. Polowinczak and Vincent F. Eslick It is certified that error appears in the above-identified patent and that said Letters Patent is hereby corrected as shown below:

Column 1, line 64, the word appearing as "that" should be -- than --

Column 3, line 45 (FIG. 9), after the word "of" insert -- FIG. 7. --

Column 3, line 57 (FIG. 16), the words appearing as "tilt-latch" should be --latch bolt--

Column 3, line 63 (FIG. 18), the numerals appearing as "8-8" should be --19-19 --

Column 3, line 66 (FIG. 19), the numerals appearing as "19-19" should be -- 8-8 --

Column 4, line 2 (FIG. 20), the numerals appearing as "8-8" should be -- 19- 19--

Column 4, line 5 (FIG. 21), the numerals appearing as "19-19" should be -- 8-8 --

Column 4, line 7 (FIG. 22), the numeral appearing as "21" should be --20--

Column 4, line 11 (FIG. 23), the numerals appearing as "8-8" should be -- 19-19 --

Column 4, line 14 (FIG. 24), the numerals appearing as "19-19" should be -- 8-8 --

Column 9, line 6, the words appearing as "type shorter type" should be -- shorter type --

Column 9, line 23, the word appearing as "smother" should be --smoother--

Signed and Sealed this

Fifth Day of December, 2006

JON W. DUDAS
*Director of the United States Patent and Trademark Office*